US007156077B2

(12) United States Patent
Koller et al.

(10) Patent No.: US 7,156,077 B2
(45) Date of Patent: Jan. 2, 2007

(54) FUEL SYSTEM FOR INTERNAL COMBUSTION ENGINE

(75) Inventors: Keith Scott Koller, Grosse Ile, MI (US); Donald Ignasiak, Farmington Hills, MI (US); Thomas Joseph Luley, Grosse Ile, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 159 days.

(21) Appl. No.: 10/904,908

(22) Filed: Dec. 3, 2004

(65) Prior Publication Data

US 2006/0118093 A1 Jun. 8, 2006

(51) Int. Cl.
*F02M 37/04* (2006.01)

(52) U.S. Cl. ..... 123/467; 123/497

(58) Field of Classification Search ..... 123/467, 123/497

See application file for complete search history.

(56) References Cited

U.S. PATENT DOCUMENTS 3,507,263 A * 4/1970 Long ..... 123/455
3,827,409 A * 8/1974 O'Neill ..... 123/458
4,142,497 A * 3/1979 Long ..... 123/456
4,601,274 A * 7/1986 Seilly ..... 123/450
5,411,376 A 5/1995 Fournier et al.
5,456,233 A * 10/1995 Felhofer ..... 123/447
5,458,104 A 10/1995 Tuckey
5,651,347 A 7/1997 Oi et al.
5,845,621 A * 12/1998 Robinson et al. ..... 123/456
6,102,010 A * 8/2000 Isozumi et al. ..... 123/506
6,230,684 B1 * 5/2001 Furuhashi et al. ..... 123/467
6,863,814 B1 * 3/2005 Okabe et al. ..... 210/416.4
6,901,912 B1 * 6/2005 Onishi et al. ..... 123/456

* cited by examiner

*Primary Examiner*—Thomas Moulis
(74) *Attorney, Agent, or Firm*—Diana D. Brehob; Artz and Artz, P.C.

(57) ABSTRACT

A fuel system for an internal combustion engine uses a fuel pump having an internally mounted pressure-responsive buffer which increases the volume available for fuel within the pump's discharge port upon shutdown of the pump, so as to assist in the mitigation of fugitive hydrocarbon emissions from fuel injectors which might otherwise result from a hot soak of an automotive engine.

2 Claims, 1 Drawing Sheet

FUEL SYSTEM FOR INTERNAL COMBUSTION ENGINE

BACKGROUND OF THE INVENTION

1. Field of the Invention

The present invention relates to a fuel system for an engine, in which a fuel pump has an integral subsystem for limiting the fluid pressure increase within the fuel supply line and injectors when the engine is shut down.

2. Disclosure Information

Fuel injected spark ignition engines present a particular challenge to automotive designers inasmuch as shut down of a fully warmed engine may cause fugitive hydrocarbon emissions upon restarting of the engine if the fluid pressure within the fuel line and injectors builds excessively due to hot soaking. U.S. Pat. No. 5,458,104 represents an attempt to solve this problem by introducing a vacuum and spring driven diaphragm pressure regulator in line between fuel pump and the engine. Unfortunately, the device of the '104 patent, being mounted externally of the fuel pump, and also having a vacuum connection to the engine's inlet manifold, may be susceptible to a failure mode in which a puncture or loss of integrity of the diaphragm results in fuel being aspirated into the engine through the vacuum connection, thereby resulting in both a loss of fuel control capability and excessive hydrocarbon emissions. Furthermore, the device of the '104 patent may cause an undesirable increase in fuel system pressure.

A fuel pump and system according to the present invention will help to prevent excessive pressure from building during a hot engine shutdown, while at the same time providing a robust system in which any leakage of the fuel pump's buffer system is confined within the pump housing.

SUMMARY OF THE INVENTION

A fuel system for an internal combustion engine includes a fuel tank adapted for containing a supply of liquid fuel, a plurality of fuel injectors, and a fuel pump for transferring fuel from the tank to the injectors under pressure. The fuel pump has a discharge passage leading to a discharge port, and a pressure-responsive buffer mounted within the fuel pump discharge port in fluid connection with the fuel pump discharge passage. The buffer has a larger fluid volume corresponding to operation at a maximum pump discharge pressure and a smaller fluid volume corresponding to a minimum pressure which corresponds roughly to the pressure when the pump is not in operation. The buffer has an outer wall which is in contact with fuel contained within the discharge port and is itself connected to the fuel pump discharge passage.

Flow to the buffer mounted within the fuel pump's discharge port according to the present invention is controlled in part by a check valve connected to the fuel pump discharge passage. The buffer itself may include either a resilient bellows such as a corrugated metallic or non-metallic bellows, or a resiliently biased piston mounted within a cylinder having a first end connected to the pump's discharge passage and a second end in fluid communication with fuel contained within the discharge port.

A fuel pump according to the present invention may be mounted within a fuel tank, or externally to a fuel tank.

The combination of a pressure-responsive buffer and a one-way pressure-responsive valve, such as a check valve mounted within fuel pump's discharge port provides the following functions:

Upon shutdown of the pumping element, fuel will be prevented from flowing in reverse from the fuel line into the pump's discharge passage. Also upon shutdown of the pumping element, fuel will be permitted to flow from the buffer into the pump's discharge passage, thereby reducing the volume of the discharge port of which is occupied by the buffer. This produces the effect of reducing the volume of fuel in the fuel system downstream from the fuel pump, which assists in the prevention of excessive pressure build-up during a subsequent hot soak period. Finally, upon start-up of the pumping element, fuel will be prevented from flowing into the fuel line and the pump discharge port until the pressure-responsive buffer has been filled with fuel.

It is an advantage of the present invention that a fuel system according to this invention will reduce leakage from injectors during hot-soak conditions.

It is a further advantage of the present invention that the present buffer is configured so that fuel will not be discharged externally from the fuel system, and the pumping and fuel delivery capability of the fuel system will not become compromised in the event that the buffer becomes inoperative.

As noted above, during engine operation, the fuel in the fuel rail remains relatively cool because cooler fuel is constantly being introduced into the fuel rail from the fuel tank and further because a constant supply of cool air is being supplied to the upper engine through the intake manifold. At engine shut down, these cooling effects cease an and heat stored in the engine block and cylinder heads conducts back into the fuel rail. The volume of the buffer accounts for the thermal expansion of the liquid fuel as the temperature of the rail increases. In essence, the present invention advantageously introduces a volume buffer which accounts for the thermal expansion of the fuel.

Other advantages, as well as objects and features of the present invention, will become apparent to the reader of this specification.

DETAILED DESCRIPTION OF THE PREFERRED EMBODIMENTS

Figure 1:
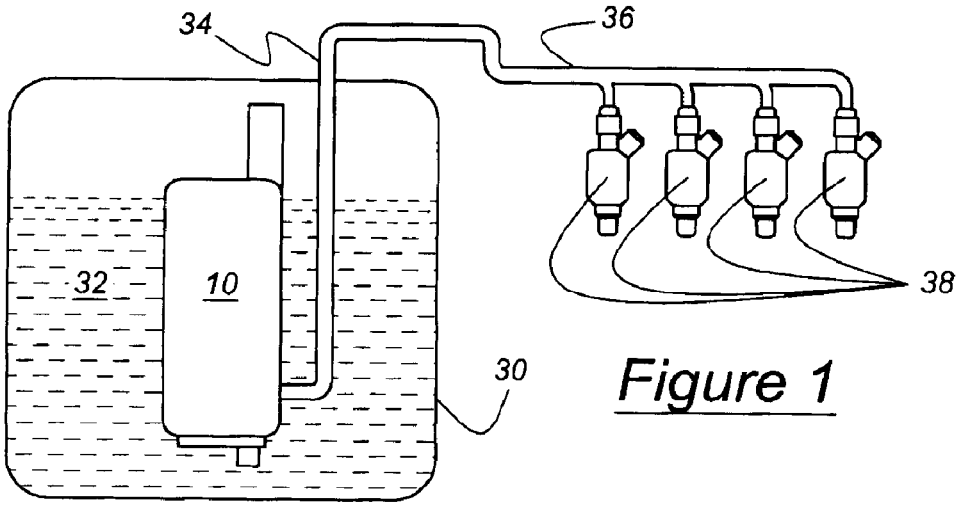
FIG. 1 is a schematic representation of a fuel system according to the present invention.

As shown in FIG. 1, fuel pump 10 is mounted within fuel tank 30 having a level of liquid fuel 32 therein. Fuel discharged by fuel pump 10 moves through fuel line 34 to fuel rail 36. Fuel then moves from fuel rail 36 to a plurality of injectors, 38. Fuel pump 10 need not be mounted in tank 30 according to the present invention, because as dictated by packaging or other considerations, pump 10 could be mounted externally of fuel tank 30.

Figure 2:
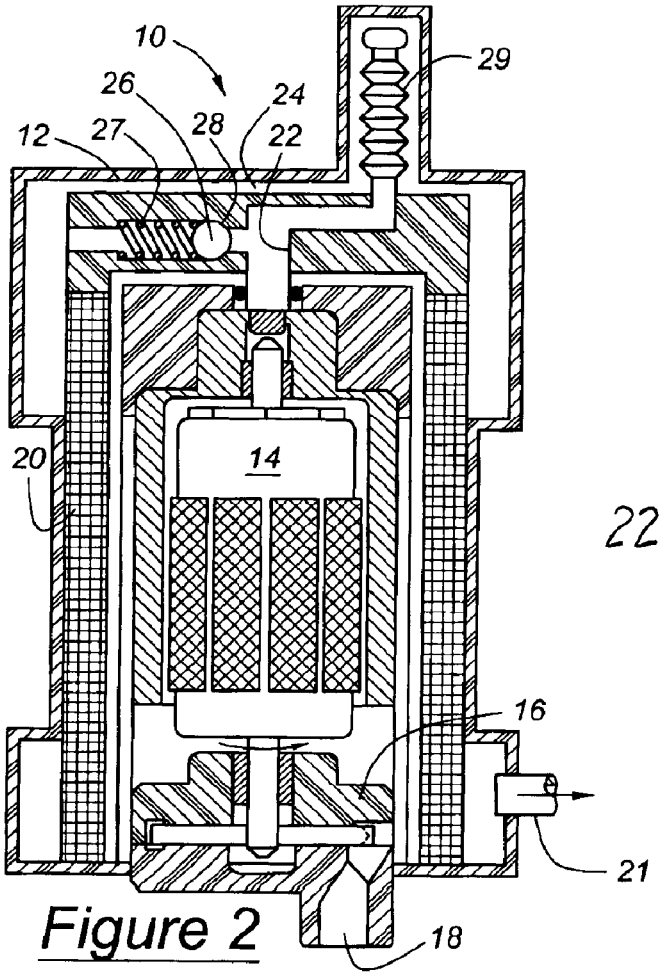
FIG. 2 illustrates a fuel pump according to the present invention.

As shown in FIG. 2, fuel pump 10 has a housing 12, with motor 14 and pump section 16 mounted therein. Taken together, motor 14 and pump section 16 comprise a pumping element. Fuel pumped by the pumping element is inducted by the pumping element through pump inlet 18 and is discharged through discharge passage 22. Fuel ultimately passes through filter 20 and leaves the pump via outlet 21.

Discharge port 24 is located about the upper portion of pump 10. A pressure-responsive buffer, in the case illustrated in FIG. 2, bellows 29, is mounted within port 24 and is connected with discharge passage 22. A pressure-responsive valve including check ball 26, biasing spring 27, and seat 28, are mounted within discharge port 24 so as to further control the flow of fuel through discharge passage 22.

Bellows 29 acts effectively as a buffer having a greatest fluid volume corresponding to operation at a maximum pump discharge pressure, and a smallest fluid volume corresponding to minimum pump pressure when the pump is not in operation. When motor 14 is energized pump section 16 begins turning, so as to build pressure within discharge passage 22, fuel will not flow past check ball 26 until bellows 29 has filled sufficiently and become inflexibly extended to a point at which the pressure within bellows 29 is equal to the pressure required to push ball 26 off of seat 28 against the force of spring 27. Thereafter, bellows 29 will remain at an extended position until motor 14 is shut down.

Upon the shut-down of motor 14 and pump section 16, fuel pressure within discharge passage 22, and correspondingly, the pressure within bellows 29, will decay, and as a result, two actions will occur. First, bellows 29 will decrease in volume and this will increase the volume available for fuel within discharge port 24. The second action which occurs is that check ball 26 will be forced onto seat 28 by spring 27. This will prevent backflow of fuel through discharge passage 22 from fuel line 34. However, upon shut-down of the pumping motor 14 and pump 16, fuel will be permitted to flow from bellows 29 into discharge passage 22 which will, as described above, reduce the volume of discharge port 24 which is occupied by the buffer. This will give fuel confined within fuel line 34, fuel rail 36, and injectors 38 more space to expand, thereby helping to avoid fugitive hydrocarbon emissions during a soak period either immediately following engine shut down, or during later diurnal cycling.

Figure 3:
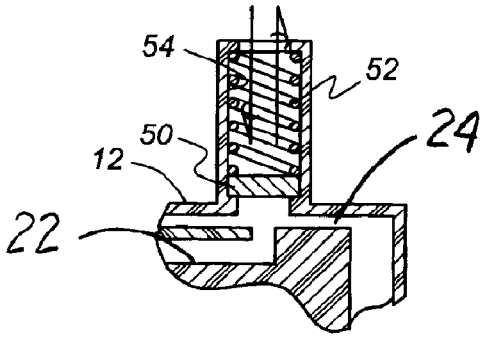
FIG. 3 illustrates an alternative pressure-responsive buffer according to the present invention.

FIG. 3 illustrates an alternative embodiment of a buffer according to the present invention in which piston 50 is slidingly mounted within cylinder bore 54 and is resiliently biased by spring 52. Piston 50 and spring 52 function within cylinder bore 54 in the manner previously ascribed to that of bellows 29. In other words, when motor 14 and pump section 16 are actuated, piston 50 will be driven upwardly against the resilient biasing force of spring 52, and when motor 14 is shut down, fuel located below piston 50 will be pushed back through discharge passage 22, allowing the volume above piston 50 to be added to the volume of discharge port 24.

Although the present invention has been described in connection with particular embodiments thereof, it is to be understood that various modifications, alterations, and adaptations may be made by those skilled in the art without departing from the spirit and scope of the invention set forth in the following claims.

What is claimed is:

1. A fuel system for an internal combustion engine, comprising:

a fuel tank adapted for containing a supply of liquid fuel; a plurality of fuel injectors;

a fuel pump mounted within said fuel tank, with said pump adapted to transfer fuel from said tank under pressure to said injectors, with said fuel pump having a pumping element and a pump body, and with said fuel pump further having a discharge passage for supplying fuel to a discharge port located within said pump body;

a fuel line extending from said fuel pump discharge port to said injectors;

a pressure-responsive buffer mounted within said fuel pump discharge port in fluid connection with said fuel pump discharge passage, with said buffer having a larger fluid volume corresponding to operation at a maximum pump discharge pressure and a smaller fluid volume corresponding to a minimum pressure when the pump is not in operation; and a one-way pressure-responsive valve mounted within said fuel pump discharge port in fluid connection with said fuel pump discharge passage such that fuel will be prevented from flowing from said fuel line into said discharge passage upon shutdown of said pump, and with said pressure-responsive valve also preventing fuel from flowing into said fuel line until said pressure-responsive buffer has been filled during pump startup.

2. A fuel pump for transferring liquid fuel from a fuel tank to at least one fuel line connected with injectors of an internal combustion engine, comprising:

a pump body;

a pumping element housed with said pump body, with said pumping element having a discharge passage;

a discharge port located within said pump body and adapted to receive fuel flowing from said discharge passage;

a pressure-responsive buffer mounted within said fuel pump discharge port in fluid connection with said fuel pump discharge passage; and a one-way pressure-responsive valve mounted within said fuel pump discharge port in fluid connection with said fuel pump discharge passage and said buffer such that:

upon shutdown of said pumping element, fuel will be prevented from flowing from said fuel line into said discharge passage;

upon shutdown of said pumping element, fuel will be permitted to flow from said buffer into said discharge passage thereby reducing the volume of said discharge port which is occupied by said buffer; and upon startup of said pumping element, fuel will be prevented from flowing into said fuel line from said discharge port until said pressure-responsive buffer has been filled with fuel.

* * * * *